US011649750B2

(12) United States Patent
Ayesh

(10) Patent No.: US 11,649,750 B2
(45) Date of Patent: May 16, 2023

(54) METHODS AND SYSTEMS FOR AN EXHAUST MUFFLER SYSTEM

(71) Applicant: Ford Global Technologies, LLC, Dearborn, MI (US)

(72) Inventor: Hani Mohammad Ayesh, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 612 days.

(21) Appl. No.: 16/655,108

(22) Filed: Oct. 16, 2019

(65) Prior Publication Data

US 2021/0115824 A1 Apr. 22, 2021

(51) Int. Cl.
*F01N 1/16* (2006.01)
*F01N 1/08* (2006.01)

(52) U.S. Cl.
CPC ..... *F01N 1/166* (2013.01); *F01N 1/083* (2013.01); *F01N 1/163* (2013.01); *F01N 2470/16* (2013.01)

(58) Field of Classification Search
CPC ..... F01N 1/083; F01N 1/166; F01N 1/163; F01N 2410/10; F01N 2470/16; F01N 2470/20
See application file for complete search history.

(56) References Cited

U.S. PATENT DOCUMENTS

| | | | | |
|---|---|---|---|---|
| 5,775,100 | A | 7/1998 | Sloss et al. | |
| 6,131,696 | A | 10/2000 | Esslinger | |
| 9,605,580 | B2 * | 3/2017 | Drees | F01N 1/168 |
| 2007/0261395 | A1 * | 11/2007 | Mahnken | F01N 3/0235 60/297 |
| 2009/0229913 | A1 | 9/2009 | Tonietto et al. | |
| 2018/0238208 | A1 * | 8/2018 | Saxman | F01N 1/165 |
| 2019/0136739 | A1 * | 5/2019 | Muramatsu | F01N 1/006 |

FOREIGN PATENT DOCUMENTS

| | | | | |
|---|---|---|---|---|
| CN | 108104904 | A * | 6/2018 | F01N 1/082 |
| DE | 102013208946 | A1 * | 11/2014 | F01N 1/023 |
| DE | 102013219332 | A1 * | 3/2015 | F01N 1/166 |
| DE | 102019128764 | A1 * | 4/2021 | |
| EP | 3141720 | A1 * | 3/2017 | F01N 1/163 |
| JP | 2009215941 | A * | 9/2009 | |
| JP | 2009215942 | A * | 9/2009 | F01N 1/166 |
| WO | WO-2018083650 | A1 * | 5/2018 | F01N 1/00 |

* cited by examiner

*Primary Examiner* — Jeremy A Luks
(74) *Attorney, Agent, or Firm* — Vincent Mastrogiacomo; McCoy Russell LLP

(57) ABSTRACT

Methods and systems are provided for an exhaust muffler system with multiple inlets of different diameters. In one example, the muffler system may include multiple sets of inlet pipes to a muffler with each set of inlet pipes including pipes of different diameters with valves controlling exhaust flow into the inlet pipes. Exhaust from an engine bank may flow to a distinct set of inlet pipes and a distinct outlet pipe of the muffler via a separate exhaust passage.

4 Claims, 6 Drawing Sheets

METHODS AND SYSTEMS FOR AN EXHAUST MUFFLER SYSTEM

FIELD

The present description relates generally to methods and systems for an exhaust muffler system with multiple inlets of different diameters.

BACKGROUND/SUMMARY

Vehicle mufflers receive exhaust gases from an engine, such as an internal combustion engine or a diesel engine, for the purpose of attenuating the noise associated with the moving exhaust gas stream. Mufflers may include a plurality of tubes and sound attenuating chambers formed by baffles and/or chambers within a shell. The walls of the tubes may include small openings to attenuate sound waves and reduce noise levels surrounding the vehicle. Due to regulations, a higher level of noise attenuation may be desired in certain regions.

Various approaches are provided for mufflers attenuating and regulating exhaust noise. In one example, as shown in U.S. Patent Application No. 2009/0229913, Tonietto et al. teaches a dual mode exhaust muffler for the engine of a vehicle that may be operated in a quiet mode and a loud mode. The muffler may include three tubes with two tubes including structures such as openings for noise attenuation. A valve may control exhaust flow entering the tubes with attenuating structures. In a desired quiet mode, the valve opening may be adjusted to flow exhaust through each of the three tubes to attain the desirable exhaust sound attenuation. Whereas, in the loud mode, the valve may be actuated to a position to block exhaust gas from flowing through the attenuating tubes, thereby maintaining the higher noise levels of exhaust gas exiting the vehicle via the tailpipe.

However, the inventors herein have recognized potential issues with such systems. As one example, inclusion of a plurality of attenuating structures in a muffler may cause an increase in exhaust backpressure which may adversely affect engine power. In a smaller vehicle, the size of the muffler and the positioning options for muffler inlets and outlets may be limited, thereby making noise attenuation along with exhaust backpressure reduction challenging. Exhaust tuning valves may be used for adjusting noise level of exhaust exiting the vehicle; however, due to packaging constraints, the tuning valve at the inlet of the muffler reduces the tuning flexibility. The proximity of the muffler to the exhaust manifold, turbine, and catalysts may cause the temperature of the muffler to increase which may adversely affect the attenuation efficiency of the muffler.

In one example, the issues described above may be addressed by a method for an engine, comprising: a muffler system including two or more sets of inlet pipes to a muffler, each set of inlet pipes in the two or more sets including pipes of different diameters, two or more valves controlling exhaust flow through the pipes of different diameters, and each set of inlet pipes leading to one of two or more outlet pipes of the muffler system. In this way, by adjusting exhaust flow path through tubes of different diameters, attenuation of exhaust noise may be improved without a significant increase in exhaust backpressure.

As one example, a muffler system may include two sets of inlet pipes with the smaller diameter pipe opening to a baffled chamber within the muffler and the larger diameter pipe directly coupling to an outlet pipe via outlet perforations. Each set of inlet pipes may fluidically couple to the exhaust manifold of an engine bank. A valve may be positioned in the larger diameter pipe downstream of the smaller diameter pipe to adjust exhaust gas flow through the smaller diameter pipe and the larger diameter pipe. If a quiet mode is elected, the valve may be closed and the exhaust may be routed via the smaller diameter pipe, a center chamber of the muffler, baffle perforations, an outer chamber of the muffler, outlet perforations, and the outlet pipe. Whereas, if the quiet mode is not selected, the valve may be maintained in an open position and exhaust may flow through the larger diameter pipe, the outlet perforations, and the outlet pipe.

In this way, by flowing exhaust through pipes of different diameters, attenuation of exhaust noise may be increased while reducing exhaust backpressure. In the quiet mode, by flowing exhaust through the smaller diameter pipe and then expanding the gas in the center chamber, higher attenuation may be attained. Exhaust flow through the baffle perforations and outlet perforations may add acoustical impedance which may further attenuate the noise. The technical effect of operating the muffler system with the valve open during conditions when the quiet mode is not desired is that the smaller diameter pipe may function as a low frequency Helmholtz tuner which may improve the acoustics of the system without significantly affecting backpressure. By flowing the exhaust through the outlet perforations, exhaust sound attenuation may be achieved without sacrificing engine power. By distributing exhaust flow over multiple inlet pipes and muffler chambers, muffler durability may be improved due to reduced stress on each pipe and muffler end cap. Overall, a balance may be attained between sound attenuation and exhaust back pressure reduction, thereby improving operator satisfaction and fuel efficiency.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
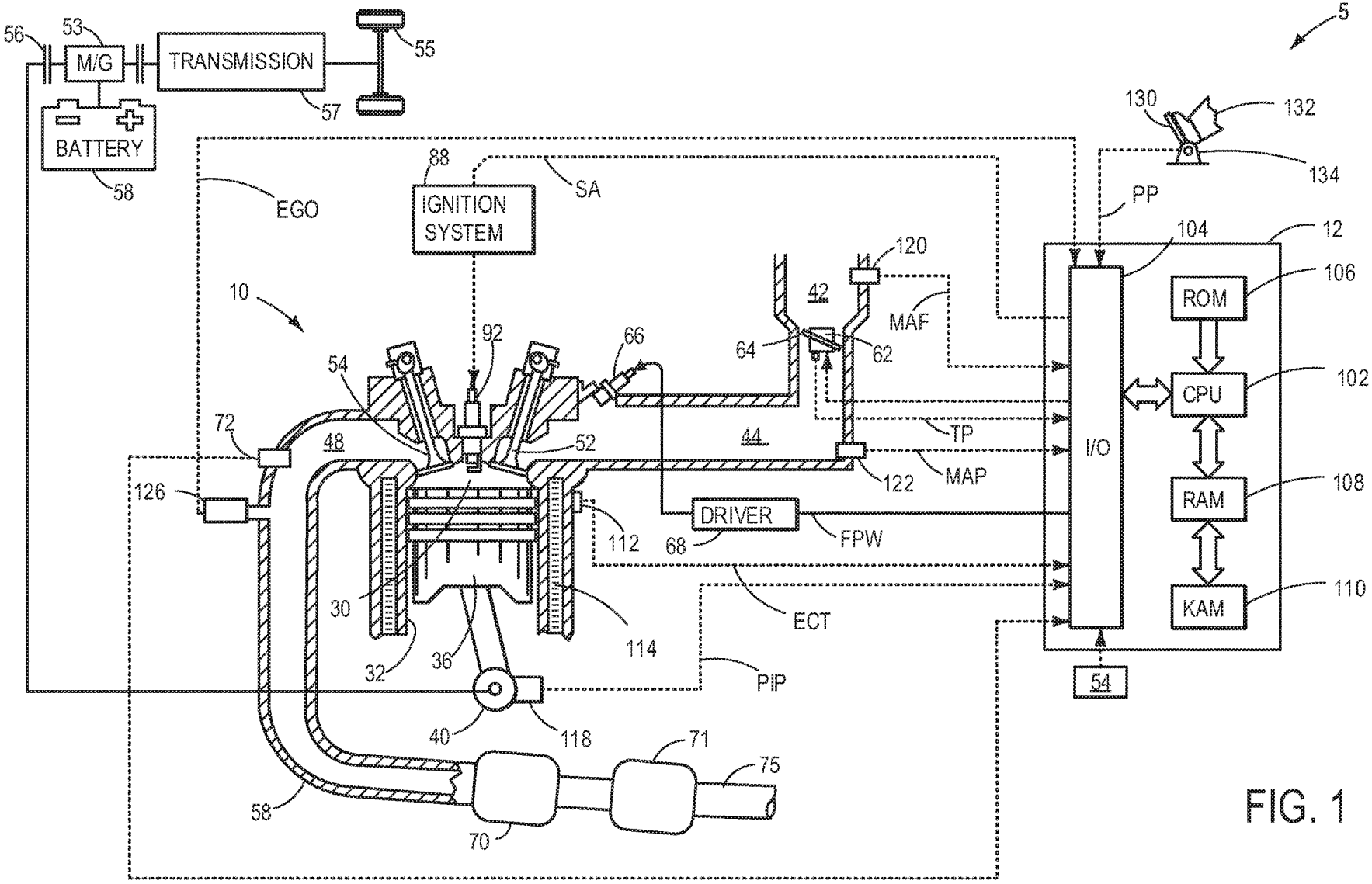
FIG. 1 schematically shows an engine with a muffler system.
Figure 2:
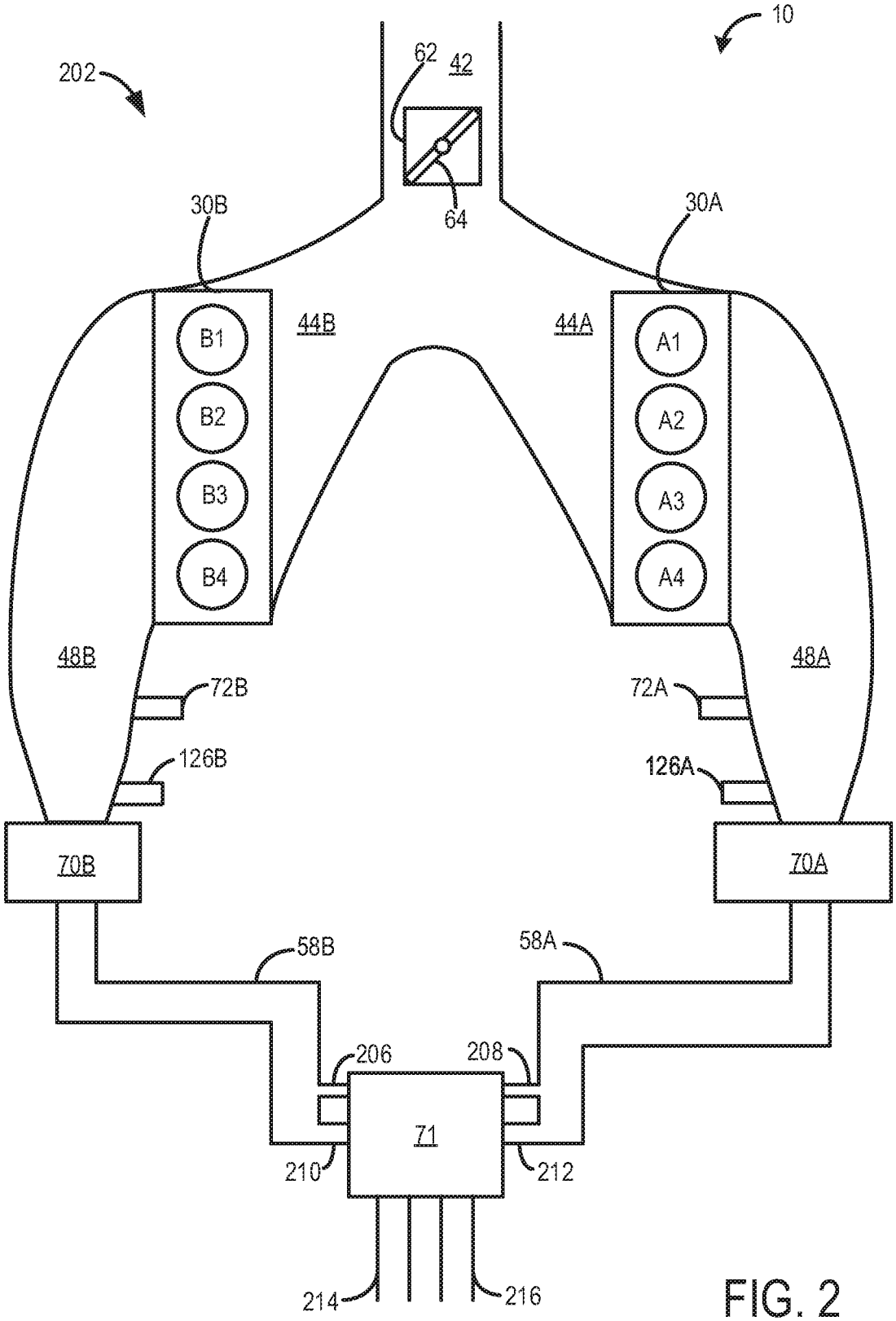
FIG. 2 schematically shows a V-engine with a dual bank exhaust system leading to the muffler system.
Figure 3A:
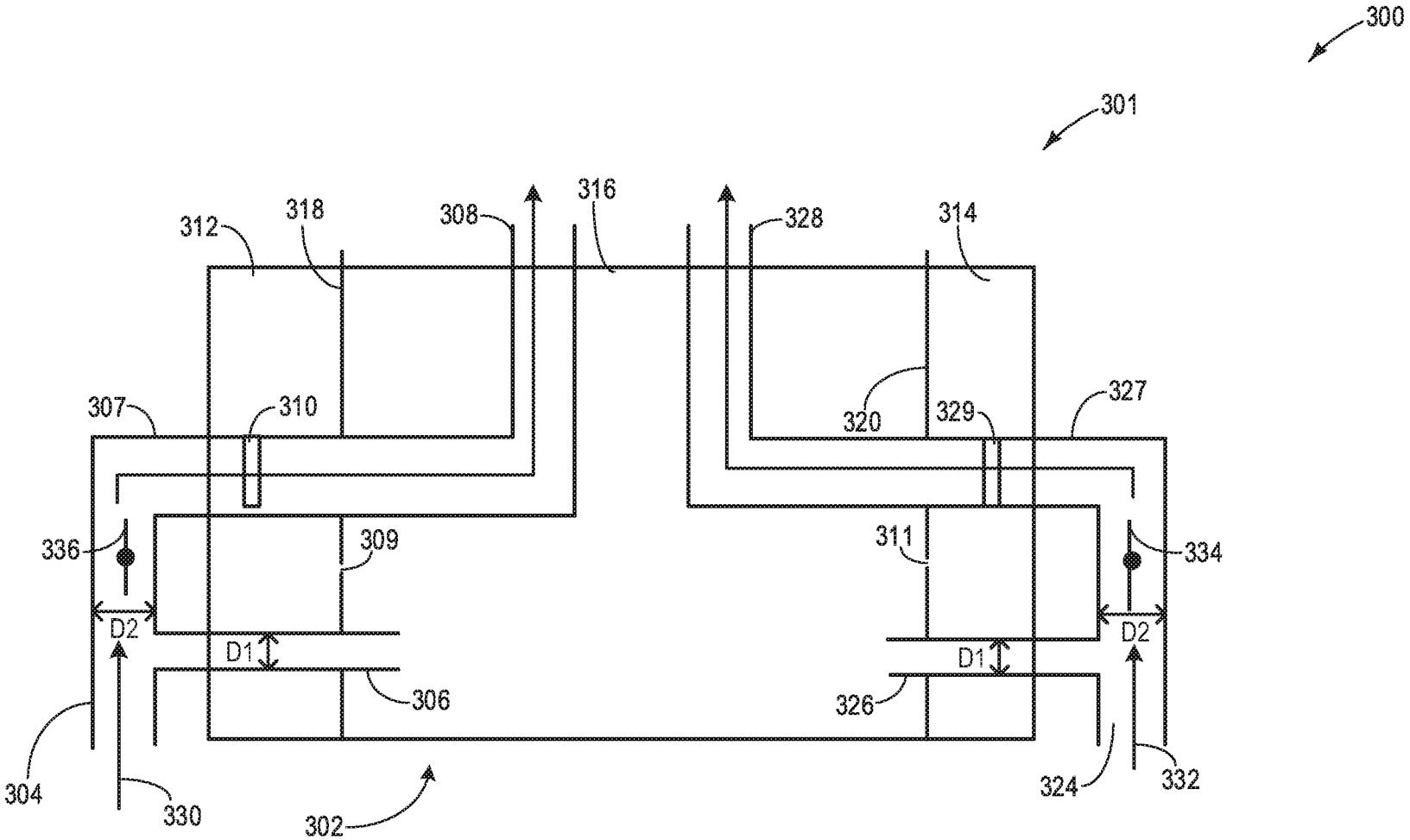
FIG. 3A schematically shows the muffler system with multiple inlet pipes operating in a first mode.
Figure 3B:
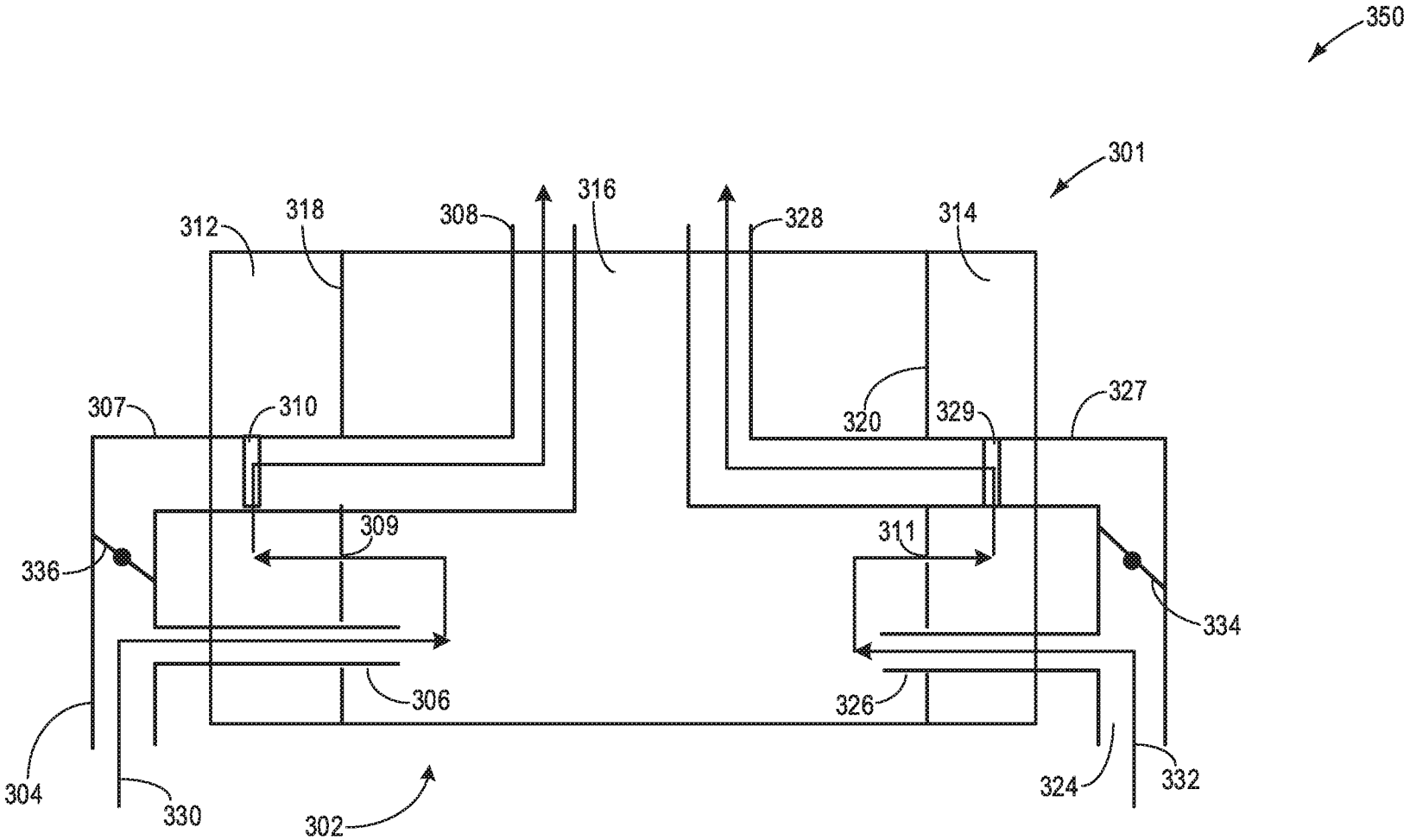
FIG. 3B schematically shows the muffler system with multiple inlet pipes operating in a second mode.

The following description relates to systems and methods for an exhaust muffler system with multiple inlet pipes of different diameters. FIGS. 1 and 2 show an engine system with two cylinder banks with each bank leading to a muffler system. The muffler system with multiple inlet pipes is shown in FIGS. 3A-B. An engine controller may be configured to perform control routines, such as the example routine of FIG. 4, to adjust operation of the muffler system based on a desired exhaust noise level. An example operation of the muffler system is shown in FIG. 5.

Turning to FIG. 1, a schematic diagram of one cylinder of multi-cylinder engine 10, which may be included in a propulsion system of a vehicle 5, is shown. Vehicle 5 may be configured for on-road propulsion. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber 30 (also termed, cylinder 30) of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel (not shown) to enable a starting operation of engine 10.

Combustion chamber 30 may receive intake air from intake manifold 44 via intake passage 42 and may exhaust combustion gases via exhaust manifold 48. Exhaust manifold 48 may include a temperature sensor 72. Intake manifold 44 and exhaust manifold 48 can selectively communicate with combustion chamber 30 via respective intake valve 52 and exhaust valve 54. In some embodiments, combustion chamber 30 may include two or more intake valves and/or two or more exhaust valves.

Fuel injector 66 is shown arranged in intake manifold 44 in a configuration that provides what is known as port injection of fuel into the intake port upstream of combustion chamber 30. Fuel injector 66 may inject fuel in proportion to the pulse width of signal FPW received from controller 12 via electronic driver 68. Fuel may be delivered to fuel injector 66 by a fuel system (not shown) including a fuel tank, a fuel pump, and a fuel rail. In some embodiments, combustion chamber 30 may alternatively or additionally include a fuel injector coupled directly to combustion chamber 30 for injecting fuel directly therein, in a manner known as direct injection.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 coupled upstream of throttle 62 for measuring the flow rate of aircharge entering into the cylinder through throttle 62. Intake passage 42 may also include a manifold air pressure sensor 122 coupled downstream of throttle 62 for measuring manifold air pressure MAP.

In some embodiments, a compression device, such as a turbocharger or supercharger, including at least a compressor (not shown), may be arranged along intake manifold 44. For a turbocharger, the compressor may be at least partially driven by a turbine (not shown), for example via a shaft, the turbine arranged along exhaust manifold 48. For a supercharger, the compressor may be at least partially driven by the engine and/or an electric machine, and may not include a turbine.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 58 upstream of emission control device 70. Sensor 126 may be any suitable sensor for providing an indication of exhaust gas air-fuel ratio such as a linear oxygen sensor or UEGO (universal or wide-range exhaust gas oxygen), a narrow band (older systems treat as a two-state device) oxygen sensor or EGO, a HEGO (heated EGO), a NOx, HC, or CO sensor. Emission control device 70 is shown arranged along exhaust passage 58 downstream of exhaust gas sensor 126. The emission control device 70 may be a three-way catalyst (TWC), SCR catalyst, NOx trap, a gasoline particulate filter (GPF), a combination of two or more of these devices, or one of various other emission control devices.

Further, engine 10 may include an exhaust gas recirculation (EGR) system (not shown) to help lower NOx and other emissions. The EGR system may be configured to recirculate a portion of exhaust gas from the engine exhaust to the engine intake. In one example, the EGR system may be a low pressure EGR system wherein exhaust gas is recirculated from downstream of gasoline emission control device 70 to the engine intake.

The exhaust passage 58 may also include a muffler 71. The muffler 71 may attenuate exhaust noise. A lower level of exhaust noise may sometimes be desired by the operation such as based on neighborhood of travel (proximal to school) or time of day (early morning). In one example, an operator may select a quiet mode of operation of the muffler 71 via an input to a dashboard console (such as touchscreen on a human machine interface) or a smart device (such as smart phone, tablet) communicatively connected to the engine control system. Based on the exhaust sound level selected, the controller may adjust a valve of the muffler 71 to route exhaust through a desired flow path corresponding to the selected sound level.

An exhaust passage receiving exhaust gas from an engine bank may lead to one of two or more sets of inlet pipes. Each set of inlet pipes in the two or more sets include a first inlet pipe and a second inlet pipe, a diameter of the first inlet pipe different from a diameter of the second inlet pipe. In one example, the diameter of the first inlet pipe may be smaller than the diameter of the second inlet pipe. In another example, the diameter of the first inlet pipe may be larger than the diameter of the second inlet pipe. The exhaust passage from the engine bank may bifurcate to form the first inlet pipe and the second inlet pipe. The first inlet pipe may lead to a center chamber of the muffler 71, the muffler 71 including a center chamber positioned between a first outer chamber and a second outer chamber. The second inlet pipe may directly lead to an outlet pipe of the muffler 71. The center chamber of the muffler 71 may be separated from the first outer chamber by a first baffle and the center chamber may be separated from the second outer chamber by a second baffle, each of the first baffle and the second baffle including baffle perforations. The second inlet pipe may be fluidically coupled to one of the first outer chamber and the second outer chamber via outlet perforations. A valve may be positioned downstream of a junction of the first inlet pipe and the second inlet pipe and upstream of the outlet perforations to regulate exhaust gas flow through each of the first inlet pipe and the second inlet pipe. When the valve is actuated to an open position, in the open position of each valve, exhaust gas from the exhaust passage may be routed via each of the second inlet pipe, the outlet perforations, and the outlet pipe. When the valve is actuated to a closed position, exhaust gas from the exhaust passage may be routed via each of the first inlet pipe, the center chamber, the baffle perforations, one of the first outer chamber and the second outer chamber, outlet perforations, the second inlet pipe, and the outlet pipe. Each of the baffle perforations and outlet perforations may include a plurality of individual holes. The muffler 71 is further discussed in relation to FIGS. 2 and 3.

Vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 53. Electric machine 53 may be a motor or a motor/generator. Crankshaft 40 of engine 10 and electric machine 53 are connected via a transmission 57 to vehicle wheels 55 when one or more clutches 56 are engaged. In the depicted example, a first clutch 56 is provided between crankshaft 40 and electric machine 53, and a second clutch 56 is provided between electric machine 53 and transmission 57. Controller 12 may send a signal to an actuator of each clutch 56 to engage or disengage the clutch, so as to connect or disconnect crankshaft 40 from electric machine 53 and the components connected thereto, and/or connect or disconnect electric machine 53 from transmission 57 and the components connected thereto. Transmission 57 may be a gearbox, a planetary gear system, or another type of transmission. The powertrain may be configured in various manners including as a parallel, a series, or a series-parallel hybrid vehicle.

Electric machine 53 receives electrical power from a traction battery 59 to provide torque to vehicle wheels 55. Electric machine 53 may also be operated as a generator to provide electrical power to charge battery 59, for example during a braking operation.

Controller 12 is shown in FIG. 1 as a microcomputer, including microprocessor unit 102, input/output ports 104, an electronic storage medium for executable programs and calibration values shown as read only memory 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; position of the active exhaust valve 75 from position sensor 76; exhaust temperature in the exhaust manifold from sensor 72, and absolute manifold pressure signal, MAP, from sensor 122. Engine speed signal, RPM, may be generated by controller 12 from signal PIP.

Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses for each revolution of the crankshaft. Further, the controller 12 may receive one or more of a crankshaft acceleration signal from a crankshaft acceleration sensor, a vehicle wheel speed signal from a wheel speed sensor, steering movements from a steering sensor, and angular velocity and slip-angle of a yaw sensor. Additionally, controller 12 may communicate with a cluster display device, for example to alert the driver of faults in the engine or exhaust system. Storage medium read-only memory 106 can be programmed with computer readable data representing instructions executable by processor 102 for performing the methods described below as well as other variants that are anticipated but not specifically listed.

The controller 12 receives signals from the various sensors of FIG. 1 and employs the various actuators of FIG. 1 to adjust engine operation based on the received signals and instructions stored on a memory of the controller. For example, adjusting engine sound level may include actuating the active exhaust valve 75 to adjust the amount of exhaust gas flowing through the active exhaust valve 75.

A navigation system 54 may be coupled to the controller 12 to determine a real-time location of the vehicle 5 at any given time (such as during vehicle travel) via a global positioning satellite (GPS) system. The navigation system may be connected to an external server and/or network cloud via wireless communication. The controller 12 may be coupled to a wireless communication device for direct communication of the vehicle 5 with a network cloud. Using the wireless communication device and the navigation system 54, the controller 14 may retrieve road conditions, traffic conditions, elevation, and other travel conditions.

Turning to FIG. 2, an example version of engine 10 that includes multiple cylinders arranged in a V configuration (e.g., V-Engine) is shown as V-engine 202. Engine 202 includes a plurality of combustion chambers or cylinders. The plurality of cylinders of engine 202 are arranged as groups of cylinders on distinct engine banks. In the depicted example, engine 202 includes two engine cylinder banks 30A, 30B. Thus, the cylinders are arranged as a first group of cylinders (four cylinders in the depicted example) arranged on first engine bank 30A and label A1-A4, and a second group of cylinders (four cylinders in the depicted example) arranged on second engine bank 30B labeled B1-B4. It will be appreciated that while the example depicted in FIG. 1 shows a V-engine with cylinders arranged on different banks, this is not meant to be limiting, and in alternate examples, the engine may be an in-line engine with all engine cylinders on a common engine bank.

Engine 202 can receive intake air via an intake passage 42 communicating with branched intake manifold 44A, 44B. Specifically, first engine bank 30A receives intake air from intake passage 42 via a first intake manifold 44A while second engine bank 30B receives intake air from intake passage 142 via second intake manifold 44B. While engine banks 30A, 30B are shown with a common intake manifold, it will be appreciated that in alternate examples, the engine may include two separate intake manifolds. The amount of air supplied to the cylinders of the engine can be controlled by adjusting a position of throttle 62 on throttle plate 64. Additionally, an amount of air supplied to each group of cylinders on the specific banks can be adjusted by varying an intake valve timing of one or more intake valves coupled to the cylinders.

Combustion products generated at the cylinders of first engine bank 30A are directed to one or more emission control devices in first exhaust manifold 48A where the combustion products are treated before being vented to the atmosphere. A first emission control device 70A is coupled to first exhaust manifold 48A. First emission control device 70A may include one or more exhaust catalysts. Exhaust gas generated at first engine bank 30A is treated at emission control device 70A.

Combustion products generated at the cylinders of second engine bank 30B are exhausted to the atmosphere via second exhaust manifold 48B. A second emission control device 70B is coupled to second exhaust manifold 48B. Second emission control device 70B may include one or more exhaust catalysts. Exhaust gas generated at second engine bank 30B is treated at emission control device 70B.

While FIG. 2 shows each engine bank coupled to respective underbody emission control devices, in alternate examples, each engine bank may not be coupled to respective emission control devices 70A, 70B but to a common underbody emission control device positioned downstream in a common exhaust passageway.

Various sensors may be coupled to engine 202. For example, a first exhaust gas sensor 126A may be coupled to the first exhaust manifold 48A of first engine bank 30A, upstream of first emission control device 70A while a second exhaust gas sensor 126B is coupled to the second exhaust manifold 48B of second engine bank 30B, upstream of second emission control device 70B. In further examples, additional exhaust gas sensors may be coupled downstream of the emission control devices. Still other sensors, such as temperature sensors, may be included, for example, coupled to the underbody emission control device(s). As elaborated in FIG. 2, the exhaust gas sensors 126A and 126B may include exhaust gas oxygen sensors, such as EGO, HEGO, or UEGO sensors. Various temperature sensors may be included in the exhaust system of engine 202, including exhaust manifold temperature sensors 72A and 72B (adapted to measure temperature of exhaust gas within the exhaust manifold to which they are coupled). In alternate embodiments, the exhaust system may not include some or all of these temperature sensors, and instead, temperatures may be modeled based on other engine operating conditions, as explained further herein.

The first exhaust manifold 48A may lead to a first exhaust passage 58A via the first emission control device 70A, and the second exhaust manifold 48B may lead to a second exhaust passage 58B via the second emission control device 70B. The first exhaust passage 58A may bifurcate into a first inlet pipe 208 and a second inlet pipe 212 leading to the muffler 71. The second exhaust passage 58B may bifurcate into a third inlet pipe 206 and a fourth inlet pipe 210 leading to the muffler 71. The diameter of the first inlet pipe 208 and the second inlet pipe 206 may be smaller relative to the diameter of the second inlet pipe 212 and the fourth inlet pipe 210. A first outlet pipe 216 and a second inlet pipe 214 may be coupled to the muffler 71 to flow exhaust from the muffler 71 out to the tailpipe and the atmosphere. A method of operation of the muffler 71 is elaborated with reference to FIG. 4.

In one example, the engine may include a single engine bank and exhaust from the single engine bank may be routed to the muffler via two inlet pipes (such as the first inlet pipe 208 and the second inlet pipe 212). Exhaust may flow out of the muffler 71 via a single outlet pipe 216 (such as single outlet pipe 216).

FIGS. 3A-B show a muffler system 301 including a muffler 302. In one example, muffler 302 may be the muffler 71 in FIGS. 1-2. On one side, a first exhaust passage 324 (originating from a first engine bank) may bifurcate into a first inlet pipe 326 and a second inlet pipe 327 leading to the muffler 302. On another side, a second exhaust passage 304 (originating from a second engine bank) may bifurcate into a third inlet pipe 306 and a fourth inlet pipe 307 leading to the muffler 302. Each of the first inlet pipe 326 and the second inlet pipe 327 may enter the muffler from the one side, and each of the third inlet pipe 306 and the fourth inlet pipe 307 may enter the muffler 302 from the other side. The first and second inlet pipes may extend parallel to each other while the third and fourth inlet pipes extend parallel to each other. In one example, each of the inlet pipes may have a circular cross-section. Each of the first inlet pipe 326 and the third inlet pipe 306 may have a smaller diameter relative to the diameter of the second inlet pipe 327 and the fourth inlet pipe 307. In one example, the diameter of the first inlet pipe 326 (as shown by D1 in FIG. 3A) and the third inlet pipe 306 (as shown by D1 in FIG. 3A) may be 2 inches (e.g., 5 cm) while the diameter of each of the second inlet pipe 327 (as shown by D2 in FIG. 3A) and the fourth inlet pipe 307 (as shown by D2 in FIG. 3A) may be 2.75 inches (e.g., 7 cm). In another example, the cross-section of each of the inlet pipes may be oval, square, rectangular, and any other shape. As an example, the area of cross-section of the second inlet pipe 327 and the fourth inlet pipe 307 may be 25-50% larger than that of the first inlet pipe 326 and the third inlet pipe 306.

The muffler 302 may include a center chamber 316, a first outer chamber 314, and a second outer chamber 312. The center chamber 316 may be separated from the first outer chamber 314 via a first baffle 320 while the center chamber 316 may be separated from the second outer chamber 312 via a second baffle 318. The first baffle 320 may include first baffle perforations 311 to allow fluidic communication between the center chamber 316 and the first outer chamber 314. The second baffle 318 may include second baffle perforations 309 to allow fluidic communication between the center chamber 316 and the second outer chamber 312. In one example, each of the first baffle perforations and the second baffle perforations may include 36 individual perforations with each perforation having a diameter of 5 mm.

Each of the first inlet pipe 326 and the third inlet pipe 306 may open to the center chamber 316. A first valve 334 may be coupled to the second inlet pipe 327 to regulate exhaust flow through the second inlet pipe 307. A second valve 336 may be coupled to the fourth inlet pipe 307 to regulate exhaust flow through the fourth inlet pipe 307.

First outlet perforations 329 may allow fluidic communication between the first outer chamber 314 and the second inlet pipe 327. Second outlet perforations 310 may allow fluidic communication between the second outer chamber 312 and the fourth inlet pipe 307. The first outlet perforations 329 and the second outlet perforations 310 may be positioned downstream of the first valve 334 and the second valve 336 respectively. In one example, each of the first outlet perforations 329 and the second outlet perforations 310 may include 194 individual perforations (holes) with each perforation having a diameter of 5 mm. Downstream of the first outlet perforations 329, the second inlet pipe 327 may lead to a first outlet pipe 328, and downstream of the second outlet perforations 310, the fourth inlet pipe 327 may lead to a second outlet pipe 308. Each of the first outlet pipe 328 and the second outlet pipe 308 may exit the muffler from the top of the muffler 302.

FIG. 3A shows an example 300 operation of the muffler system 301 in a first mode. The first mode may also be termed as the engine power priority mode as during operation in this mode, exhaust back pressure is reduced thereby improving engine power output. In the first mode, each of the first valve 334 and the second valve 336 may be in their respective open positions. Exhaust gas from a first engine bank may flow into the muffler system via the first exhaust passage 324 while exhaust gas from a second engine bank may flow into the muffler system via the second exhaust passage 304. Due to the open position of the first valve 334, the exhaust gas entering through the first exhaust passage 324 may flow through the second inlet pipe 327 unobstructed. Likewise, due to the open position of the second valve 336, the exhaust gas entering through the second exhaust passage 304 may flow through the fourth inlet pipe 307 unobstructed. The exhaust gas entering the second inlet pipe 327 may then flow through the first outlet perforations 329 while the exhaust gas entering the fourth inlet pipe 307 may then flow through the second outlet perforations 310. The outlet perforations may add a controlled level of higher frequency broadband attenuation to the sound of the exhaust gas passing through the muffler system. The frequency and range of sound attenuation at the outlet perforations may be a function of the size of each perforation as well as the location of the perforations along the pipes 327 and 307. After passing through the outlet perforations, the exhaust gas flowing through the second inlet pipe 327 (and through the fourth outlet pipe 307) may be routed to the tailpipe (and then the atmosphere).

A smaller portion of the exhaust gas from each of the first exhaust passage 324 and the second exhaust passage 304 may enter the center chamber 316 via the first inlet pipe 326 and the third inlet pipe 306, respectively. The mixing of the exhaust gas from the engine banks may improve sound quality and character. After mixing in the center chamber, the exhaust may enter the first outer chamber 314 and the second outer chamber 312 via first baffle perforations 311 and the second baffle perforations 309 respectively. Communication of a small portion of the exhaust gas through the lower diameter pipes (first inlet pipe 326 and third inlet pipe 306) may improve quality and character of exhaust sound. From the first outer chamber 314, the exhaust gas is routed to the second inlet pipe 327 via the first outlet perforations 329 and from the second outer chamber 312, the exhaust gas is routed to the fourth inlet pipe 307 via the second outlet perforations 310. The smaller portion of the exhaust gas routed through the center chamber may recombine with the primary exhaust gas flow through the second inlet pipe 327 and the fourth inlet pipe 307.

Since during operation in the first mode, the primary exhaust flow is confined within the inlet pipes and a larger volume of the exhaust gas may not flow through the muffler 302 and is not expanded or impeded, exhaust backpressure may be reduced. Reduction of exhaust backpressure may result in increased engine performance and fuel efficiency. While operating in the first mode, the lower diameter pipes (first inlet pipe 326 and third inlet pipe 306) and the muffler 302 volume may act as low frequency Helmholtz tuner. The tuning improves quality of exhaust sound while having minimal effect on exhaust backpressure. The level of tuning attained may be adjusted based on size and shape (such as length, diameter, number of baffle perforations) of the lower diameter tubes and the muffler 302. In this way, exhaust backpressure may be reduced while exhaust sound is attenuated and the exhaust sound quality is improved. Since the entire exhaust gas flow is not routed through the muffler, durability of the muffler may be improved.

FIG. 3B shows an example 350 operation of the muffler system 301 in a second mode. The second mode may also be termed as the quiet mode as during operation in this mode, a lower level of exhaust sound (sound audible to the vehicle passengers or outside the vehicle due to exhaust gas flow from engine to the atmosphere via the exhaust system and the tailpipe) is desired. In the second mode, each of the first valve 334 and the second valve 336 may be in their respective closed positions. Exhaust gas from the first engine bank may flow into the muffler system via the first exhaust passage 324 while exhaust gas from the second engine bank may flow into the muffler system via the second exhaust passage 304.

Due to the first valve 334 and the second valve 336 being closed, exhaust gas from first exhaust passage 324 may enter the first inlet pipe 326 and the exhaust gas from second exhaust passage 304 may enter the third inlet pipe 306. Due to the flow of exhaust through the smaller diameter tubes (first inlet pipe 326 and third inlet pipe 306) first, the exhaust sound may be attenuated. Exhaust from each of the first inlet pipe 326 and the third inlet pipe 306 may then enter the center chamber 316 wherein the exhaust flow is expanded. Expansion of the gas creates broadband attenuation of sound. Further, exhaust gas flow in the center chamber 316 may smooth out pulses of exhaust flow by mixing exhaust flow from two engine banks which may further attenuate the sound.

From the center chamber 316, the exhaust may enter the first outer chamber 314 and the second outer chamber 312 via first baffle perforations 311 and the second baffle perforations 309 respectively. Exhaust flow through the baffle perforations may add acoustical impedance, thereby increasing sound attenuation. The level of attenuation attained and the associated change in backpressure may be adjusted based on the number of individual openings in the baffle perforations. The exhaust flow upon entering the outer chamber may further expand and cause sound level attenuation.

From the first outer chamber 314, the exhaust gas is routed to the second inlet pipe 327 via the first outlet perforations 329 and from the second outer chamber 312, the exhaust gas is routed to the fourth inlet pipe 307 via the second outlet perforations 310. Exhaust gas flow through the outlet perforations may add impedance, thereby further attenuating the exhaust sound. The level of attenuation attained and the corresponding change in exhaust backpressure may be adjusted based on the number of individual openings in the outlet perforations. The location of the outlet perforations (with each of the second inlet pipe 327 and the fourth inlet pipe 307) may be adjusted to affect a standing wave in the larger diameter pipes (the second inlet pipe 327 and the fourth inlet pipe 307) and facilitate in tuning the sound. In this way, in the quiet mode, by flowing exhaust through the smaller diameter pipes and expanding exhaust within the muffler chambers, a higher level of attenuation of exhaust sound may be attained. By limiting the number of baffles within the muffler 302, exhaust backpressure may be reduced.

In this way, the components of FIGS. 1 and 2 enable an on-board controller including computer-readable instructions stored on non-transitory memory to: upon indication of operation of the muffler system in a quite mode, actuate a valve coupled downstream of a junction of a smaller diameter inlet pipe and a larger diameter inlet pipe originating from an exhaust passage coupled to an engine bank to a closed position, route exhaust through the smaller diameter inlet pipe, a center chamber of a muffler, baffle perforations in a baffle separating the center chamber form an outer chamber, outlet perforations fluidically coupling the larger diameter inlet pipe and the outer chamber, the larger diameter inlet pipe, and an outlet pipe to attenuate exhaust sound. When quite mode is not indicated, the valve is actuated to an open position to route exhaust directly from the exhaust passage to the larger diameter inlet pipe, then route the exhaust to the outlet pipe via the outlet perforations to reduce exhaust backpressure.

Figure 4:
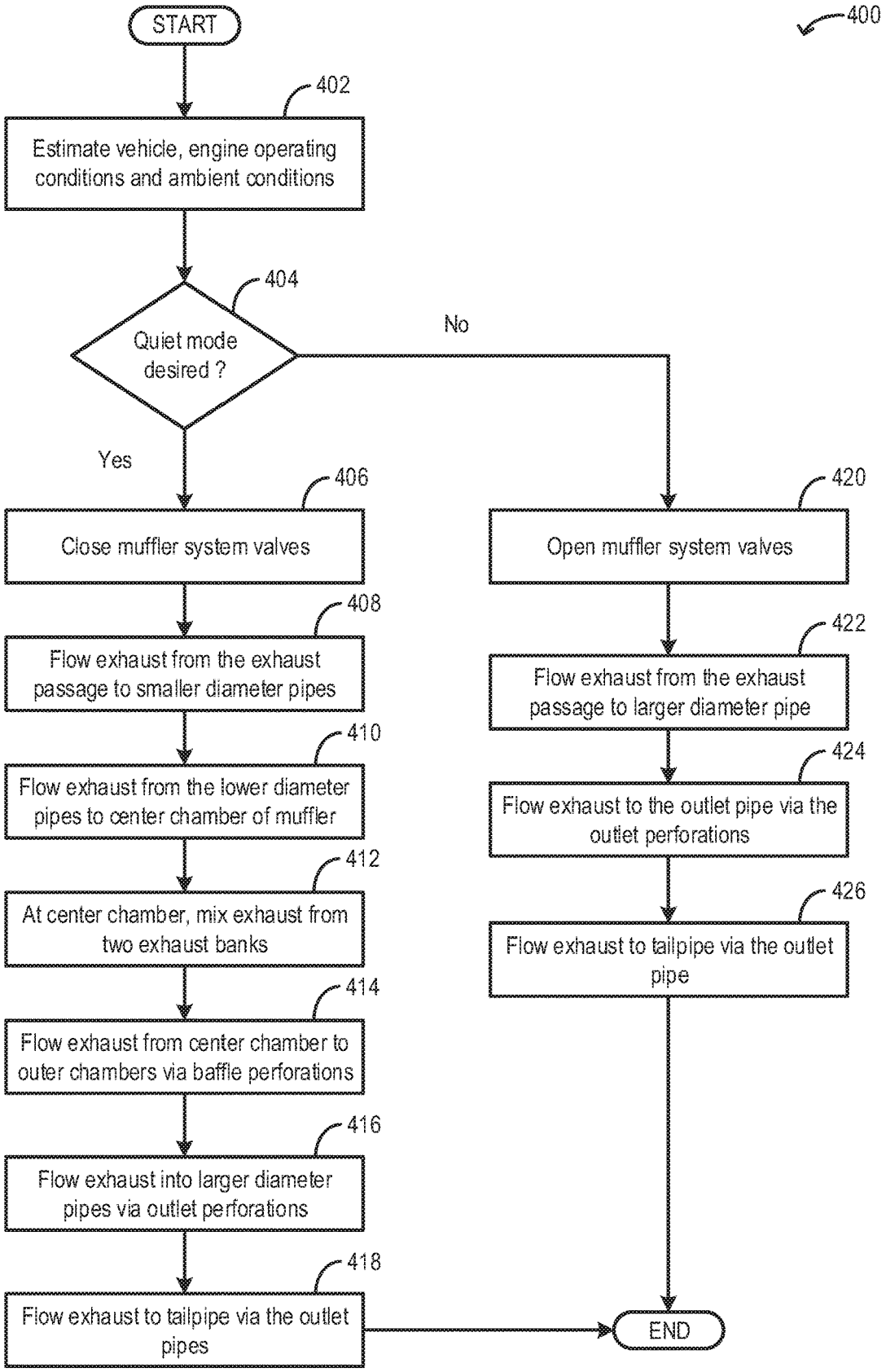
FIG. 4 shows a flow chart of an example method for operating the muffler system.
Figure 5:
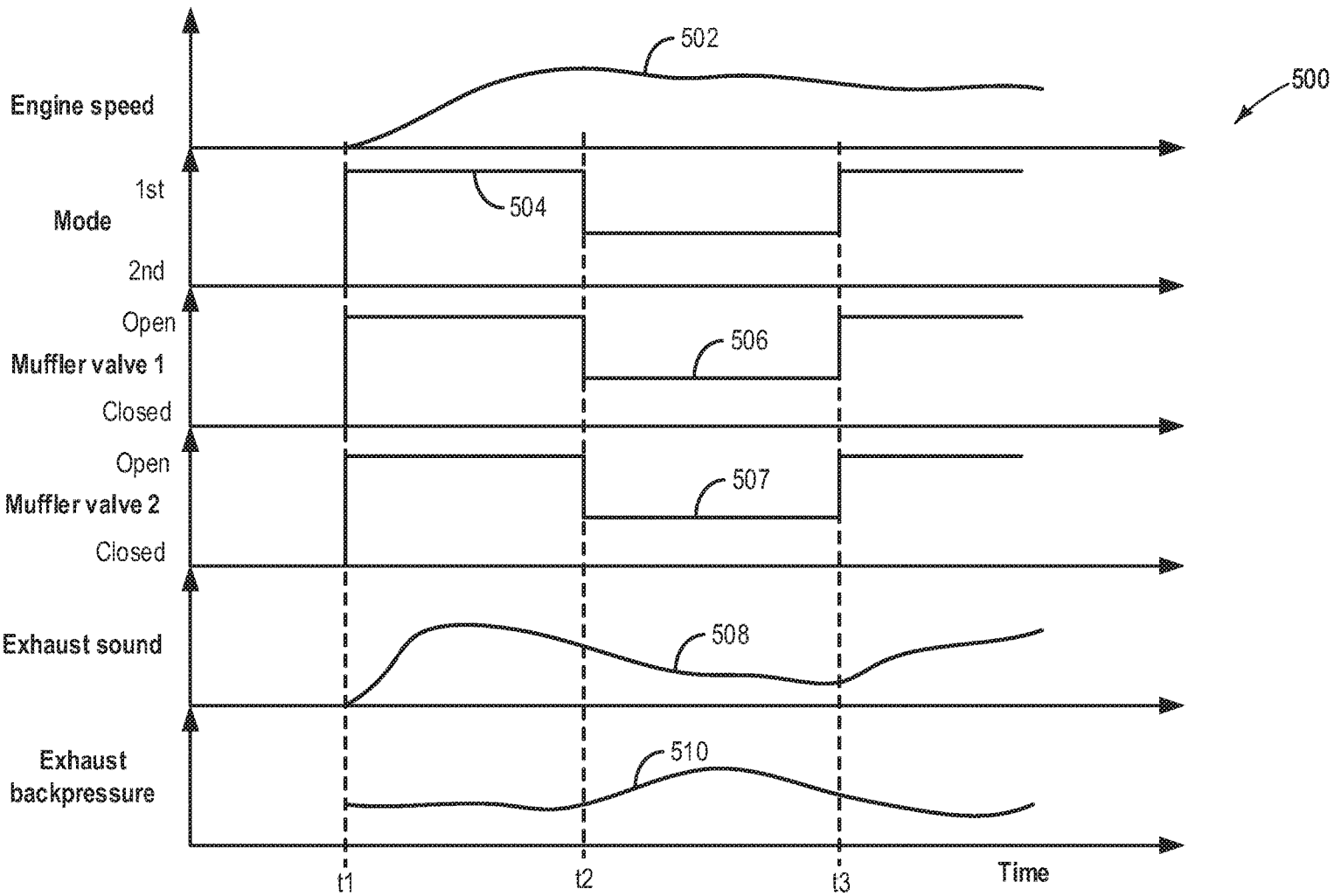
FIG. 5 shows an example operation of the muffler system.

FIG. 4 shows a flow chart of a method 400 for operating a muffler system (such as muffler system 301 in FIGS. 3A-B). As explained above, an exhaust system of a vehicle may include a muffler system adapted to control exhaust sound to a desired level. Exhaust sound is defined as a sound audible to the vehicle passengers or outside the vehicle due to exhaust gas flow from engine to the atmosphere via the exhaust system and the tailpipe. Instructions for carrying out method 400 and the rest of the methods included herein may be executed by a controller (e.g., controller 12 of FIG. 1) based on instructions stored on a memory of the controller and in conjunction with signals received from sensors of the engine system, such as the sensors described above with reference to FIGS. 1-3A,B. The controller may employ engine actuators of the engine system to adjust engine operation, according to the methods described below.

The method begins at 402 and includes estimating and/or measuring engine operating conditions. Engine operating conditions may include engine speed and/or load, engine temperature, ambient temperature, exhaust manifold temperature, exhaust temperatures in the exhaust pipes, gas pressures, mass air flow, etc. The vehicle location may be determined based on inputs from an onboard navigation system and/or from an external server. Further, permissible sound levels at the location of the vehicle may be retrieved from an onboard and/or off-board database.

At 404, the method includes determining if a quiet mode of operation is desired for the muffler system. In a quiet mode of operation, the exhaust sound is attenuated to a higher level relative to muffler system operation outside the quiet mode. A lower exhaust sound may be desirable by the operator during vehicle travel through certain neighborhoods (such as proximal to schools and/or hospitals). Also, the operator may desire a lower exhaust sound during certain time periods of the day such as early morning. The operator may select a quiet mode of operation of the muffler via an input to a dashboard console (such as touchscreen on a human machine interface) or a smart device (such as a smart phone or tablet) communicatively connected to the engine control system. Further, the controller may operate the muffler system in the quiet mode if it is determined that the permissible sound levels at the location of the vehicle is lower than a threshold level (such as lower than lower than 74 dBA).

If it is determined that quiet mode is desired/selected, the muffler system may be operated in a second mode as elaborated with reference to FIG. 3B. At 406, the muffler system valves (such as first valve 334 and second valve 336 in FIGS. 3A-B) allowing exhaust gas flow into the larger diameter inlet pipes (such as second inlet pipe 327 and fourth inlet pipe 307 in FIGS. 3A-B) may be closed. The controller may send a signal to the actuators of the corresponding valves to actuate the valves to respective to their respective fully closed positions. Due to the closing of the muffler system valves, the exhaust may be routed to flow from the exhaust passages corresponding to each engine bank to enter the smaller diameter inlet pipes (first inlet pipe 326 and third inlet pipe 306 in FIGS. 3A-B).

At 410, the exhaust gas may flow through the smaller diameter inlet pipes and enter the center chamber (such as center chamber 316 in FIGS. 3A-B) of the muffler (such as muffler 302 in FIGS. 3A-B). At 412, at the center chamber, the exhaust gas coming from two engine banks via the two smaller diameter inlet pipes may be mixed and expanded. Flow of exhaust through the smaller diameter pipes and subsequent expansion at the center chamber may cause attenuation of exhaust sound.

At 414, exhaust gas from the center chamber may be routed to flow to two outer chambers (such as first outer chamber 314 and second outer chamber 312 in FIGS. 3A-B) located on each side of the center chamber via baffle perforations (such as first baffle perforations 311 and second baffle perforations 309 in FIGS. 3A-B) on baffles (such as baffles 320 and 318 in FIGS. 3A-B) separating the center chamber from the outer chambers. The exhaust may be further expanded at the outer chambers. Flow through the baffle perforations and further expansion may add acoustic impedance and further attenuate the exhaust sound.

At 416, exhaust gas may be routed from the outer chambers to the larger diameter pipes via outlet perforations (such as first outlet perforations 329 and second outlet perforations 310 in FIGS. 3A-B) fluidically coupling the outer chambers to the larger diameter pipes. Flowing exhaust through the plurality of openings in the outlet perforations adds more impedance and may further facilitate sound attenuation. From the larger diameter pipes, at 418, the exhaust gas may flow to the tailpipe via the outlet pipes (such as outlet pipes 328 and 308 in FIGS. 3A-B). In this way, the exhaust gas may be routed through pipes of different diameters and muffler chambers for effective sound attenuation without a significant increase in exhaust back pressure.

If at 404 it is determined that quiet mode of operation is not desired, the muffler system may be operated in a first mode as elaborated with reference to FIG. 3A. At 420, the muffler system valves allowing exhaust gas flow into the larger diameter inlet pipes may be opened. The controller may send a signal to the actuators of the corresponding valves to actuate the valves to respective open positions. Due to the opening of the muffler system valves, at 422, the exhaust may be routed to flow from the exhaust passages corresponding to each engine bank to enter the larger diameter inlet pipes and flow through the open valves.

At 422, exhaust from the larger diameter pipes may be routed to the outlet pipe via the outlet perforations. The outlet perforations may add a higher frequency broadband attenuation to the sound of the exhaust gas passing through the muffler system. At 426, the exhaust gas may flow to the tailpipe via the outlet pipes. When the quiet mode is not desired, by confining the exhaust flow to the larger diameter pipes and the outlet pipes, backpressure may be reduced. Reduction of exhaust backpressure may result in increased engine performance and fuel efficiency. While operating in the first mode, the lower diameter pipes and the muffler volume may act as low frequency Helmholtz tuner and improve quality of exhaust sound.

In one example, the muffler system valves may be eliminated and exhaust flow in the first mode may be carried out during all engine operating conditions. Without the muffler system valves, the exhaust sound attenuation as attained by exhaust flow through the outlet perforations and operation of the smaller diameter inlet tubes as tuners may be sufficient for all conditions and further attenuation may not be desired. By confining flow of a larger portion of the exhaust gas within inlet and outlet pipes without being expanded inside the muffler body, exhaust back pressure may be reduced.

As an example, the muffler valves may be controlled based on the exhaust sound level regulations of the region where the vehicle is being operated. In one example, if the vehicle is being operated in a region (such as a state or country) with a higher exhaust sound limit, the muffler valves may not be actuated to closed position and may be maintained in the open position (first mode of operation of the muffler system) for exhaust backpressure reduction. If the vehicle is being operated in a region with stricter such as lower exhaust sound limit, the muffler valves may be selectively actuated to a closed position to attain the desired noise attenuation. In this way, a single muffler design may be used in different geographical regions to attain exhaust backpressure reduction and engine sound attenuation based on engine sound regulations of the region.

In this way, during a first condition, a muffler system may be operated in a first mode to route exhaust gas from an exhaust passage through a larger diameter inlet tube of a muffler, bypassing a smaller diameter inlet tube and a muffler chamber before exiting the muffler system via an outlet pipe; and during a second condition, a muffler system may be operated in a second mode to route exhaust gas from the exhaust passage first through the smaller diameter inlet tube, the muffler chamber, and then the larger diameter inlet tube before exiting the muffler system via the outlet pipe. During the first condition, exhaust sound level is lowered and during the second condition, exhaust backpressure is lowered. In the first mode, a valve regulating flow into each of the smaller diameter inlet pipe and the larger diameter inlet pipe is actuated to an open position and in the second mode, the valve is actuated to a closed position.

FIG. 5 shows an example timeline 500 illustrating operation of a muffler system (such as muffler system 301 in FIGS. 3A-B) to reduce exhaust sound and exhaust backpressure based on a selected mode of operation. The horizontal (x-axis) denotes time and the vertical markers t1-t3 identify significant times in the routine for muffler system operation.

The first plot, line 502, shows a change in engine speed over time as estimated via a crankshaft position sensor. The second plot, line 504, shows a mode of operation of the muffler system. The muffler may be operated in a first mode (also referred herein as engine power priority mode) or a second mode (also referred herein as a quiet mode). In the first mode, exhaust backpressure reduction is prioritized with exhaust sound attenuation and in the second mode, exhaust sound attenuation is prioritized while maintaining lower exhaust backpressure levels. The muffler system may be operated in the first mode by default while the operator may select a quiet mode of operation (second mode) of the muffler via an input to a dashboard console (such as touchscreen on a human machine interface) or a smart device (such as a smart phone or a tablet) communicatively connected to the engine control system. The third plot, line 506, shows a position of a first muffler valve (such as valve 334 in FIGS. 3A-B) regulating exhaust gas flow into a first set of smaller diameter inlet pipes or larger diameter inlet pipes of the muffler system. The fourth plot, line 507, shows a position of a second muffler valve (such as valve 336 in FIGS. 3A-B) regulating exhaust gas flow into a second set of smaller diameter inlet pipes or larger diameter inlet pipes of the muffler system. The fifth plot, line 508, shows a level of exhaust sound audible to the vehicle passengers or outside the vehicle due to exhaust gas flow from engine to the atmosphere via the exhaust system and the tailpipe. The sixth plot, line 510, shows a level of exhaust backpressure.

Prior to time t1, the engine is not operated and the vehicle is not propelled via engine torque. At time t1, the engine is started from rest by combusting fuel and air in the engine cylinders and the engine speed gradually increases. Since the quiet mode is not indicated by the operator, the muffler system may be operated in the default, first mode with the muffler valves in the open position. In the first mode, the exhaust gas is primarily routed to the outlet pipes of the muffler system via the larger diameter inlet pipes without entering one or more muffler chambers. Due to the operation of the muffler system in the first mode, a lower exhaust backpressure may be maintained with the exhaust sound remaining within regulated limits (such as below 74 dBA).

At time t2, in response to an indication from an operator (e.g., requesting to operate in the second mode), the muffler system operation is shifted from the first mode to the quieter, second mode. To operate the muffler system in the second mode, the controller sends a signal to the actuators of the muffler valves to actuate the valves to their respective closed positions. In the closed position, the exhaust gas entering the muffler system is routed through the smaller diameter inlet pipes, center chamber of the muffler, baffle perforations, outer chambers of the muffler, outlet perforations, larger diameter inlet pipes, and finally the outlet pipe. Due to the exhaust flow through the smaller diameter inlet pipes followed by expansion of exhaust gas in the muffler chambers, as seen from the change in exhaust sound levels, attenuation of exhaust sound is improved. With the decrease in exhaust sound levels during operation of the muffler system in the second mode, there is an increase in exhaust backpressure. However, the magnitude of change in backpressure does not significantly affect engine performance.

At time t3, in response to an indication by the operator that the quiet mode of operation of the muffler system is no longer desired, the controller may send a signal to the actuator(s) of the muffler valves to actuate the valves to respective open positions. In the first mode, the exhaust gas is primarily routed to the outlet pipes of the muffler system via the larger diameter inlet pipes without entering one or more muffler chambers in order to prioritize exhaust back pressure reduction and engine performance.

In this way, by adjusting a muffler system valve position and flowing exhaust through inlet pipes of different diameters, the muffler system may be operated in one of a quiet priority mode and an engine power priority mode. In the quiet mode, by flowing exhaust through the smaller diameter pipe, expanding the gas in the center chamber, and flowing through baffle perforations and outlet perforations, higher sound attenuation may be attained. In the engine power priority mode, by confining exhaust flow with larger diameter pipes and not expanding the exhaust gas in the muffler chambers, exhaust backpressure may be reduced. Overall, by operating a muffler system with different inlet pipe diameters, attenuation of exhaust sound and exhaust backpressure reaction may be attained, thereby improving engine performance and operator satisfaction.

In one example, a system for an engine, comprises: a muffler system including two or more sets of inlet pipes to a muffler, each set of inlet pipes in the two or more sets including pipes of different diameters, two or more valves controlling exhaust flow through the pipes of different diameters, and each set of inlet pipes leading to one of two or more outlet pipes of the muffler system. In the preceding example, the system further comprising, additionally or optionally, an exhaust passage configured to receive exhaust gas from an engine bank, wherein the exhaust passage leads to one set of inlet pipes of the two or more sets of inlet pipes, the engine including two or more engine banks. In any or all of the preceding examples, additionally or optionally, the set of inlet pipes of the two or more sets include a first inlet pipe and a second inlet pipe, a diameter of the first inlet pipe different from a diameter of the second inlet pipe. In any or all of the preceding examples, additionally or optionally, the diameter of the first inlet pipe is smaller than the diameter of the second inlet pipe. In any or all of the preceding examples, additionally or optionally, the exhaust passage from the engine bank bifurcates into the first inlet pipe and the second inlet pipe. In any or all of the preceding examples, additionally or optionally, the first inlet pipe leads to a center chamber of the muffler, the center chamber positioned between a first outer chamber and a second outer chamber of the muffler. In any or all of the preceding examples, additionally or optionally, the second inlet pipe directly leads to an outlet pipe. In any or all of the preceding examples, additionally or optionally, the center chamber is separated from the first outer chamber by a first baffle and wherein the center chamber is separated from the second outer chamber by a second baffle, each of the first baffle and the second baffle including baffle perforations. In any or all of the preceding examples, additionally or optionally, the second inlet pipe is fluidically coupled to one of the first outer chamber and the second outer chamber via outlet perforations. In any or all of the preceding examples, additionally or optionally, one valve of the two or more valves is located downstream of a junction of the first inlet pipe and the second inlet pipe and upstream of the outlet perforations. In any or all of the preceding examples, additionally or optionally, in an open position of each valve, exhaust gas from the exhaust passage is routed via each of the second inlet pipe, the outlet perforations, and the outlet pipe, and wherein in the closed position of each valve, exhaust gas from the exhaust passage is routed via each of the first inlet pipe, the center chamber, the baffle perforations, one of the first outer chamber and the second outer chamber, outlet perforations, the second inlet pipe, and the outlet pipe. In any or all of the preceding examples, additionally or optionally, each of the baffle perforations and outlet perforations include a plurality of individual holes.

Another example method for an engine comprises: during a first condition, operating a muffler system in a first mode to route exhaust gas from an exhaust passage through a larger diameter inlet tube of a muffler; and during a second condition, operating a muffler system in a second mode to route exhaust gas from the exhaust passage first through a smaller diameter inlet tube, a muffler chamber, and then the larger diameter inlet tube before exiting the muffler system via the outlet pipe. In the preceding example, additionally or optionally, the second condition includes an indication by an operator to operate the muffler system in the first mode, and wherein the muffler system is operated in the second mode in an absence of the indication by the operator. In any or all of the preceding examples, additionally or optionally, in the first mode, a valve regulating flow into each of the smaller diameter inlet pipe and the larger diameter inlet pipe is actuated to an open position allowing exhaust gas to flow directly from the exhaust passage to the larger diameter inlet pipe, and wherein in the second mode, the valve is actuated to a closed position to route exhaust gas to the larger diameter inlet pipe via the smaller diameter inlet pipe and the muffler chamber. In any or all of the preceding examples, additionally or optionally, in the second mode, the exhaust gas flows from the smaller diameter inlet pipe to a center muffler chamber, then from the center muffler chamber, the exhaust gas flows to an outer muffler chamber via baffle perforations on a baffle separating the center muffler chamber from the outer muffler chamber, and then the exhaust gas flows to the larger diameter inlet pipe through outlet perforations housed in the larger diameter inlet pipe. In any or all of the preceding examples, additionally or optionally, the exhaust passage routes exhaust from one bank of the engine to the muffler system, the engine including two or more banks with each bank coupled to a distinct exhaust passage bifurcating into a distinct smaller diameter inlet pipe and a distinct larger diameter inlet pipe.

In yet another example, a muffler system for an engine, comprises: a controller including executable instructions stored in non-transitory memory to: upon indication of operation of the muffler system in a quite mode, actuate a valve coupled downstream of a junction of a smaller diameter inlet pipe and a larger diameter inlet pipe to a closed position, each of the smaller diameter inlet pipe and the larger diameter inlet pipe originating from an exhaust passage coupled to an engine bank; route exhaust through the smaller diameter inlet pipe, a center chamber of a muffler, baffle perforations in a baffle separating the center chamber form an outer chamber, outlet perforations fluidically coupling the larger diameter inlet pipe and the outer chamber, the larger diameter inlet pipe, and an outlet pipe to attenuate exhaust sound. In the preceding example, additionally or optionally, the controller includes further instructions to: when the quiet mode is not indicated, actuate the valve to an open position; and route exhaust directly from the exhaust passage to the larger diameter inlet pipe, then route the exhaust to the outlet pipe via the outlet perforations to reduce exhaust backpressure. In any or all of the preceding examples, additionally or optionally, the quiet mode is indicated by an operator via an input to a dashboard console or a smart device communicatively connected to the controller.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

during a first condition, operating a muffler system in a first mode to route exhaust gas from an exhaust passage through a larger diameter inlet tube of a muffler; and during a second condition, operating the muffler system in a second mode to route exhaust gas from the exhaust passage first through a smaller diameter inlet tube, a muffler chamber, and then the larger diameter inlet tube before exiting the muffler system via an outlet pipe;

wherein, in the second mode, the exhaust gas flows from the smaller diameter inlet tube to a center muffler chamber, then from the center muffler chamber the exhaust gas flows to an outer muffler chamber via baffle perforations on a baffle separating the center muffler chamber from the outer muffler chamber, and then the exhaust gas flows to the larger diameter inlet tube through outlet perforations housed in the larger diameter inlet tube.

2. The method of claim 1, wherein the second condition includes an indication by an operator to operate the muffler system in the first mode, and wherein the muffler system is operated in the second mode in an absence of the indication by the operator.

3. The method of claim 1, wherein in the first mode, a valve regulating flow into each of the smaller diameter inlet tube and the larger diameter inlet tube is actuated to an open position allowing exhaust gas to flow directly from the exhaust passage to the larger diameter inlet tube, and wherein in the second mode, the valve is actuated to a closed position to route exhaust gas to the larger diameter inlet tube via the smaller diameter inlet tube and the muffler chamber.

4. The method of claim 1, wherein the exhaust passage routes exhaust from one bank of the engine to the muffler system, the engine including two or more banks with each bank coupled to a distinct exhaust passage bifurcating into a distinct smaller diameter inlet tube and a distinct larger diameter inlet tube.

* * * * *